US005531937A

United States Patent [19]

Minevski et al.

[11] Patent Number: 5,531,937

[45] Date of Patent: Jul. 2, 1996

[54] WATER SOLUBLE CYCLIC AMINE-DICARBOXYLIC ACID-ALKANOL AMINE SALT CORROSION INHIBITOR

[75] Inventors: Ljiljana V. Minevski, The Woodlands, Tex.; Edmund J. Bockowski, Chalfont, Pa.

[73] Assignee: Betz Laboratories, Inc., Trevose, Pa.

[21] Appl. No.: 527,146

[22] Filed: Sep. 12, 1995

Related U.S. Application Data

[63] Continuation-in-part of Ser. No. 336,144, Nov. 8, 1994, abandoned, and a continuation-in-part of Ser. No. 336,145, Nov. 8, 1994, abandoned, and a continuation-in-part of Ser. No. 367,643, Jan. 3, 1995, abandoned.

[51] Int. Cl.[6] ..... C23F 11/12; C23F 11/14

[52] U.S. Cl. ..... 252/394; 252/189; 252/392; 252/396; 203/7; 422/16; 422/17; 507/939; 106/14.42; 423/228; 423/229; 208/47

[58] Field of Search ..... 203/7; 208/47; 252/394, 392, 396, 189; 422/16, 17; 507/939; 106/14.42; 423/228, 229

[56] References Cited

U.S. PATENT DOCUMENTS

| | | | |
|---|---|---|---|
| 2,715,605 | 8/1965 | Goerner | 202/57 |
| 3,447,891 | 6/1969 | Crawford | 21/2.5 |
| 3,488,831 | 1/1970 | Ravve | 29/495 |
| 3,649,167 | 3/1972 | Sawyer | 21/2.5 |
| 3,819,328 | 6/1974 | Go | 21/2.5 R |
| 3,959,170 | 5/1976 | Mago et al. | 252/189 |
| 3,981,780 | 9/1976 | Scherrer et al. | 203/7 |
| 4,062,764 | 12/1977 | White et al. | 208/348 |
| 4,143,119 | 3/1979 | Asperger et al. | 423/226 |
| 4,229,284 | 10/1980 | White et al. | 208/348 |
| 4,250,042 | 2/1981 | Higgins | 252/8.5 C |
| 4,382,008 | 5/1983 | Boreland et al. | 252/75 |
| 4,392,972 | 7/1983 | Mohr et al. | 52/75 |
| 4,430,196 | 2/1984 | Niu | 208/47 |
| 4,490,275 | 12/1984 | Niu | 252/189 |
| 4,578,205 | 3/1986 | Yeaky et al. | 252/76 |
| 4,595,723 | 6/1986 | Henson et al. | 524/398 |
| 4,596,849 | 6/1986 | Henson et al. | 524/398 |
| 4,683,081 | 7/1987 | Kammann, Jr. et al. | 252/392 |
| 4,806,229 | 2/1989 | Ferguson et al. | 208/47 |
| 4,946,616 | 8/1990 | Falla et al. | 252/75 |
| 5,211,840 | 5/1993 | Lehrer et al. | 208/348 |
| 5,283,006 | 2/1994 | Lehrer et al. | 252/392 |
| 5,326,482 | 7/1994 | Lessard et al. | 210/743 |

OTHER PUBLICATIONS

SU 1305133A1 (Solodov et al.) 23 Apr. 1987, Chem Abstract 107:140835.

JP 58117880 (Yushiro Chem. Industry Co.) 13 Jul. 1983, Chem Abstract 100:10983.

JP 58096881 (Katayama Chemical Works Co.) 07 Dec. 1981, Chem Abstract 99:145915.

JP 04168288A2 (Osamu et al.) 16 Jun. 1992, Chem Abstract 117:176432.

FR 1562632 (Crawford, Jack D.) 04 Apr. 1969, Chem Abstract 72:23240.

CS 253368 (Jaromir et al.) 04 Jan. 1989, Chem Ab. 111:82802.

DE 3812888A1 (Vost, Guenther) 02 Nov. 1989, Chem Ab. 112:161065.

DE 3521952A1 (Geke, Juergen et al.) 02 Jan. 1987, Chem Ab. 106:123967.

DD 248077 A1 (Boehme, H. et al.) 29 Jul. 1987, Chem. Ab. 108:225532.

SU 279310 (Shillo et al.) 21 Oct. 1970, Chem Ab. 74:S6594.

FR 1510517 (Societe Continentale Parker) 19 Jan. 1968, Chem Ab. 70:49825.

SU 840087 (Shapoval et al.) 23 Jun. 1981, Chem Ab. 95:172377.

JP 63015886A2 (Ogasawara, T.) 22 Jan. 1988, Chem Ab. 108:153551.

JP 62129127A2 (Asano et al.) 11 Jun. 1987, Chem. Ab. 107:178884.

"Understanding Corrosion in Alkanolamine Gas Treating Plants", DuPart, M. S.; Bacon, T. R.,; and Edwards, D. J., *Hydrocarbon Processing*, pp. 75–80, Apr. 1993 and pp. 89–94, May 1993.

"Control of Corrosion and Fouling in Amine Sweetening Systems", Stray, James D.; Nat'l Assoc. of Corrosion Engineers Canadian Western Conf., Calgary, Alberta Canada, Feb. 20–22, 1990.

*Primary Examiner*—Gary Geist
*Assistant Examiner*—Valerie Fee
*Attorney, Agent, or Firm*—Alexander D. Ricci; Matthew W. Smith

[57] ABSTRACT

Compositions and a method of using the compositions to inhibit corrosion. The compositions are water soluble n-alkyl morpholine, saturated dicarboxylic acid, optionally alkanol amine and optionally surfactant compositions which inhibit ferrous metal corrosion when added to aqueous oxygen-free solutions.

9 Claims, No Drawings

WATER SOLUBLE CYCLIC AMINE-DICARBOXYLIC ACID-ALKANOL AMINE SALT CORROSION INHIBITOR

RELATED APPLICATION

This application is a continuation-in-part of applications Ser. No. 08/336, 144, filed Nov. 8, 1994 now abandoned, Ser. No. 08/336,145, filed Nov. 8, 1994 now abandoned, and Ser. No. 08/367,643, filed Jan. 3, 1995 now abandoned.

FIELD OF THE INVENTION

The present invention relates to corrosion inhibiting compositions. More particularly, the present invention relates to corrosion inhibiting compositions which are comprised of water soluble n-alkyl morpholines, saturated dicarboxylic acids, optionally alkanol amine and optionally a surfactant and the use of the compositions to inhibit ferrous metal corrosion in aqueous solutions.

BACKGROUND OF THE INVENTION

Corrosion is a major problem in any system in which ferrous metals are in contact with aqueous solutions. Corrosion is the electrochemical reaction of metal with its environment. It is a destructive reaction, which simply stated, is the reversion of refined metals to their natural state. For example, iron ore is iron oxide. Iron oxide is refined into steel. When the steel corrodes, it forms iron oxide which may result in failure or destruction of the metal, causing the particular aqueous system to be shut down until the necessary repairs can be made. Typical systems in which corrosion of ferrous metals is a problem include but are not limited to water based cooling systems, waste water handling systems and systems which transport or process natural gas or crude oil.

Crude oil production provides a good example of the types of systems in which ferrous metal corrosion is a problem. When crude oil is produced from an oil bearing formation the crude oil is commonly mixed with water. The water typically contains dissolved salts and is referred to in the industry as "brine". The brine can become mixed with the crude oil as a result of oil recovery flooding or is a naturally occurring fluid found in the formation from which the crude oil is recovered. One of the first processing steps which the crude oil is subjected to is the separation of the brine from the crude oil. Brine, due to the presence of dissolved salts, particularly $MgCl_2$ which hydrolyzes to form HCl, is very corrosive to the metal separation equipment and piping which separates the brine and crude oil and which transports the brine back into the environment for disposal. After brine separation, pipelines which transport oil or gas can contain some residual water which can cause corrosion problems in the piping and related equipment.

Another example of the type of system in which ferrous metal corrosion is a problem is in the removal of acid gases (typically $CO_2$ and/or $H_2S$) from crude oil or natural gas. Acid gases are commonly removed in an acid gas removal amine system (amine unit). An amine unit uses an organic amine such as monoethanolamine (MEA), diethanol amine (DEA), methyldiethanolamine (MDEA), diisopropanolamine (DIPA), diglycolamine (DGA) or triethanolamine (TEA) diluted in water as an amine solvent. The amine solvent reacts with the acid gases thereby removing them from the hydrocarbon. The amine-acid gas reaction is later reversed resulting in an acid gas stream and a reusable solvent. Unreacted $CO_2$ can form carbonic acid which causes metals in the amine unit to corrode.

Efforts to control corrosion in amine units usually focus on the use of metallurgy, minimization of acid gas flashing, filtration, stress relieving and similar mechanical design considerations. Mechanical design considerations, process controls and chemical corrosion inhibitors help reduce corrosion in amine units but do not eliminate the problem.

Since corrosion, if left untreated, can cause shut down of a system, corrosion control is an important consideration in any operations in which ferrous metal contacts water.

Accordingly, a need exists for relatively low toxicity compositions which, when added to an aqueous system, inhibit corrosion of ferrous metals.

PRIOR ART

U.S. Pat. No. 4,683,081 to Kammann, Jr. et al. discloses low-foaming, water soluble, rust preventive compositions comprising a partial amide of alkanolamine and unsaturated dicarboxylic acid together with an aliphatic dicarboxylic acid and one or more alkanolamines. The compositions are useful in systems such as water-based metal-working fluids, corrosion inhibition in gasolines and fuel oils where water is a trace component, water based cooling and recycle streams, oil well drilling and in soluble oils.

U.S. Pat. No. 4,250,042 to Higgins discloses salts of polycarboxylic acids and amino compounds as corrosion inhibitors in aqueous systems used in well-drilling operations. Higgins compositions have utility in systems in which oxygen is present as air or as oxygen added to the system.

SUMMARY OF THE INVENTION

The present invention provides water soluble compositions for inhibiting corrosion of ferrous metals in contact with oxygen-free aqueous solutions. The compositions comprise n-alkyl morpholine having from about 5 to about 8 carbon atoms, a saturated dicarboxylic acid having from about 10 to about 18 carbon atoms, optionally a di or tri alkanol amine having from about 4 to about 15 carbon atoms and optionally a surfactant.

The invention also provides a method for inhibiting corrosion of ferrous metals in contact with oxygen-free aqueous solutions. The method comprises adding an amount of the invention composition to an oxygen-free aqueous solution sufficient to establish a concentration of composition in the aqueous solution effective for the purpose of inhibiting ferrous metal corrosion. The invention is particularly useful for inhibiting corrosion in oxygen-free aqueous systems such as crude oil production and transportation pipelines and $CO_2$ removal amine units.

DETAILED DESCRIPTION OF THE INVENTION

In accordance with the present invention, a method and composition for inhibiting corrosion of ferrous metals in aqueous solutions is provided. As used herein, the words "aqueous solution" mean any liquid in which water is a component. The words "oxygen-free" mean that the aqueous solution is substantially free of oxygen, with oxygen present, if at all, in only trace amounts as an undesirable contaminant. The present inventors have discovered that a corrosion inhibitor based on a n-alkyl morpholine, a saturated dicarboxylic acid, optionally an alkanol amine, and optionally a surfactant when added to an aqueous oxygen-free solution significantly inhibits the corrosion of ferrous metals in the contact with the aqueous oxygen-free solution and by current standards exhibits relatively low biological toxicity. The mechanism by which the composition inhibits corrosion is not fully understood. However, it is believed that the composition films at the metal/aqueous solution interface and thus provides a barrier which inhibits corrosive attack of the metal surface.

The preferred corrosion inhibiting composition of the present invention is comprised of an n-alkyl morpholine having the formula:

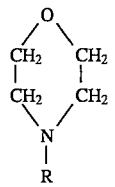

where R is a lower n-alkyl group having from about 1 to 4 carbon atoms, a saturated dicarboxylic acid having the formula:

$$HOOC—CH_2—(CH_2)_z—CH_2—COOH$$

where z=6 to 14; optionally an alkanol amine having the formula:

$$(OH—R_1)_xNH_{y-x}$$

where $R_1$ is an alkyl having from about 2 to 5 carbon atoms, x=2 or 3 and y=3; and optionally a surfactant.

The preferred n-alkyl morpholine is methyl morpholine, the preferred saturated dicarboxylic acid is 1,12-dodecanedioic acid and the preferred alkanol amines are diethanol amine and triethanol amine.

The corrosion inhibiting composition is preferably supplied as a concentrate to be diluted for use. The concentrate may comprise from about 10 to about 70 weight percent of n-alkyl morpholine, about 10 to about 55 weight percent of a saturated dicarboxylic acid, up to about 50 weight percent alkanol amine, up to about 2 weight percent surfactant, and up to about 30 weight percent water. The treatment level of corrosion inhibiting composition effective to inhibit ferrous metal corrosion is a concentration of the composition in an aqueous solution of from about 50 parts per million (ppm) to about 2000 ppm. The preferred treatment level is about 50 ppm to about 500 ppm. The most preferred treatment level is from about 50 ppm to about 300 ppm.

Suitable surfactants include tall oil fatty acid maleic anhydride derivatives such as Tenax 2010 available from Westvaco, polyoxyethylated rosin amines such as RAD 1100 available from Witco, and ethoxylate of coco primary amines such as Varonic K-15 also available from Witco.

In order to show the efficacy of inhibiting ferrous metal corrosion in an aqueous system by adding an n-alkyl morpholine-dicarboxylic acid-alkanol amine salt to an aqueous solution various tests were performed. The results are presented herein for purposes of illustration and not limitation.

EXAMPLE 1

A standard three electrode system was used for evaluating corrosion rates in the absence and presence of N-alkyl morpholine and dicarboxylic acid corrosion inhibitor.

An aqueous/hydrocarbon phase ratio of 50/50 brine:kerosene was used at 40° C. The brine phase consisted of 9.62 weight percent NaCl, 0.401 weight percent $CaCl_2 \cdot 2H_2O$, 0.186 weight percent $MgCl_2 \cdot 6H_2O$ and 89.793 weight percent water. The brine was purged with argon gas before the brine was introduced into an electrochemical cell. Purging of brine was continued with carbon dioxide. Kerosene was added on top of the purged brine and $CO_2$ purging was continued. The 100 weight percent water fluid in Table I represented the blank. Discs of mild steel 1018 were used as working electrodes.

The results are shown in percent protection as determined by calculated corrosion rates using Stern-Geary Equation/DG&G and/or Gamry Corrosion Software and the equation: %P=[(CRb−CRi)/CRb]×100 where %P is percent protection, CRb is the corrosion rate of the blank and CRi is the corrosion rate of the treated system.

The corrosion inhibitor formulations consisted of methyl morpholine and 1,12-dodecanedioic acid in the range of weight percent of morpholine per weight percent of acid of 0.43 to 4. All corrosion inhibitor formulations were prepared at a temperature of 50°–60° C. The treatment levels of corrosion inhibitor formulations present in the brine solutions were each 100 ppm. The percent protection was determined after the mild steel discs were exposed to the brine/kerosene mixture for 18 hours. Corrosion rate readings were taken hourly. The test results are shown in Table I.

TABLE I

| Weight % | | | MM/DDDA | MM/DDDA | % Protection at 100 ppm of treatment (after |
|---|---|---|---|---|---|
| $H_2O$ | MM | DDDA | | $H_2O$ | 18 hours) |
| 0 | 100 | 0 | — | — | 14 |
| 0 | 30 | 70 | 0.43 | — | 65 |
| 0 | 45 | 55 | 0.82 | — | 85 |
| 0 | 55 | 45 | 1.22 | — | 93 |
| 0 | 70 | 30 | 2.33 | — | 84 |
| 25 | 50 | 25 | 2.00 | 0.08 | 90 |
| 45 | 30 | 25 | 1.20 | 0.03 | 86 |
| 50 | 25 | 25 | 1.00 | 0.02 | 82 |
| 50 | 40 | 10 | 4.00 | 0.08 | 72 |
| 50 | 40 | 10 | 4.00 | 0.08 | 71 |
| 55 | 25 | 20 | 1.25 | 0.02 | 78 |
| 80 | 20 | 0 | — | — | 2 |
| 100 | 0 | 0 | — | — | 0 |

where MM is methyl morpholine and DDDA is dodecanedioic acid.

Table I shows that when the morpholine alone is used as a corrosion inhibitor, the percent protection from corrosion is 14% or less. However, when the morpholine and dicarboxylic acid are combined, the percent protection from corrosion is synergistically enhanced and ranges from about 65% to about 93%. The most preferred n-alkyl morpholine and saturated dicarboxylic acid formulations are those wherein the weight percent of morpholine per weight percent of acid is 0.83 to 4. The solutions tested outside this weight percent ratio had the tendency to solidify upon reaching room temperature or after about 10–20 hours.

EXAMPLE II

The aquatic toxicity of a corrosion inhibiting formulation comprising 25 weight percent water, 50 weight percent methyl morpholine and 25 weight percent dodecanedioic acid was tested by determining the half-life initial toxic effect over a 48 hour period with the Cladaceran species *Daphnia magna*. Inhibitor concentrations of 50, 100, 500, 1000 and 2000 mg/L were added to containers containing the *Daphnia magna*. The Lethal Concentration at which 50% of the *Daphnia magna* expired ($LC_{50}$) was then determined at 24 hours and at 48 hours.

After 24 hours $LC_{50}$ exceeded 2000 mg/L since no noticeable decline in Daphnia numbers were observed in any of the sample containers.

After 48 hours the 1000 mg/L sample did not decline in Daphnia numbers but the 2000 mg/L had reached the 50% mortality level indicating that at 48 hours the $LC_{50}$ is between about 1000 and 2000 mg/L.

Thus up to about 2000 mg/L of the n-alkyl morpholine and saturated dicarboxylic acid compositions added to an aqueous solution exhibits relatively low biological toxicity.

EXAMPLE III

The standard three electrode system and brine/kerosene solution described in Example I was utilized to test corrosion inhibitor formulations.

The corrosion inhibitor formulations consisted of methyl morpholine, 1,12-dodecanedioic acid, and triethanol amine in the range of weight percent of morpholine per weight percent of acid of 0.25 to 3.00 and the weight percent of morpholine per weight percent of triethanol amine of 0.20 to 1.50. The treatment levels of the corrosion inhibitor formulations present in the brine solutions were each 100 ppm. All corrosion inhibitor formulations were prepared at a temperature of 50°–60° C. The percent protection was determined after the mild steel discs were exposed to the brine/kerosene mixture for 18 hours. Corrosion rate readings were taken hourly. The test results are shown in Table II.

TABLE II

| Weight % | | | | MM | TEA | MM | % Protection at 100 ppm of treatment |
|---|---|---|---|---|---|---|---|
| $H_2O$ | MM | DDDA | TEA | DDDA | DDDA | TEA | (after 18 hours) |
| 30 | 30 | 20 | 20 | 1.50 | 1.00 | 1.50 | 88 |
| 25 | 28 | 20 | 25* | 1.40 | 1.25 | 1.12 | 90 |
| 25 | 28 | 22 | 25 | 1.27 | 1.14 | 1.12 | 82 |
| 30 | 30 | 10 | 30 | 3.00 | 3.00 | 1.00 | 79 |
| 0 | 10 | 40 | 50 | 0.25 | 1.25 | 0.20 | 80 |
| 0 | 25 | 25 | 50 | 1.00 | 2.00 | 0.50 | 77 |
| 0 | 100 | 0 | 0 | / | / | / | 14 |
| 80 | 20 | 0 | 0 | / | / | / | 2 |
| 100 | 0 | 0 | 0 | / | / | / | 0 |
| 0 | 0 | 0 | 100 | / | / | / | 1 |
| 80 | 0 | 0 | 20 | / | / | / | 19 |

where:
MM is methyl morpholine
DDDA is dodecanedioic acid
TEA is tri-ethanolamine
*remaining 2 weight % is surfactant as described in Formulation A of Example IV below.

EXAMPLE IV

The standard three electrode system and brine/kerosene solution described in Example I was utilized to test corrosion inhibitor formulations A and B. Formulation A consisted of 25 weight percent water, 28 weight percent methyl morpholine, 20 weight percent dodecanedioic acid, 25 weight percent triethanolamine and 2 weight percent polyoxyethoxylated rosin amine available commercially as RAD1100 or about 15 mole ethoxylate of coco primary amines available as Varonic K-15 both from Witco Chemical Corporation as surfactants for de-emulsifying and/or defoaming purposes.

Formulation B consisted of 30 weight percent water, 30 weight percent methyl morpholine, 20 weight percent dodecanedioic acid and 20 weight percent diethanolamine.

The treatment levels of corrosion inhibitor formulations tested in the brine were 50 ppm and 100 ppm. The percent protection was determined after the steel discs were exposed to the brine/kerosene mixture for 18 hours. The test results are shown in Table III.

TABLE III

| Wt. Percent | | | | | | MM | MM | MM | % Protection after 18 hours at | |
|---|---|---|---|---|---|---|---|---|---|---|
| $H_2O$ | MM | DDDA | DEA | TEA | surfactant | DDDA | DEA | TEA | 50 ppm | 100 ppm |
| 25 | 28 | 20 | | 25 | 2 | 1.4 | / | 1.0 | 81 | 95 |
| 30 | 30 | 20 | 20 | | | 1.5 | 1.5 | / | 91 | 93 |

Table II shows that when the alkanol amine alone is used as a corrosion inhibitor, the percent protection from corrosion is 19% or less. However, Tables II and III show that when n-alkyl morpholine, dicarboxylic acid, and alkanol amine are combined, the percent protection from corrosion is enhanced and ranges from about 77% to about 95%. The preferred n-alkyl morpholine, saturated dicarboxylic acid and alkanol amine formulations are those having morpholine to acid weight percent ratios of 1.00 to 3.00 and morpholine to alkanol amine weight percent ratios of 0.21 to 1.50. The solution tested outside these weight percent ratios had the tendency to solidify upon reaching room temperature or after about 10–20 hours.

EXAMPLE V

The aquatic toxicity of a corrosion inhibiting formulations comprising water, methyl morpholine, dodecanedioic acid, and di and tri alkanol amines were tested by determining the half-life initial toxic effect over a hour period with the Cladaceran species *Daphnia magna*. The formulations tested are shown in Table IV.

TABLE IV

| | | Composition | | | | |
|---|---|---|---|---|---|---|
| No. | $H_2O$ | MM | DDDA | DEA | TEA | RAD1100 |
| 1 | 25% | 50% | 25% | / | / | / |
| 2 | 30% | 30% | 20% | / | 20% | / |
| 3 | 25% | 28% | 20% | / | 25% | 2% |
| 4 | 30% | 30% | 20% | 20% | / | / |

where
MM is methyl morpholine
DDDA is dodecanedioic acid
DEA is di-ethanolamine
TEA is tri-ethanolamine
RAD1100 is Witco polyoxyethoxylated rosin amine (used as a surfactant)

Inhibitor concentrations of 50, 100, 500, 1000 and 2000 mg/L of formulations 1–4 were added to containers containing the Daphnia magna. The Lethal Concentration at which 50% of the *Daphnia magna* expired ($LC_{50}$) was then determined at 24 hours and at 48 hours and are shown in Table V.

TABLE V

| | $LC_{50}$ Range (mg/L) | |
|---|---|---|
| No. | 24 hours | 48 hours |
| 1 | >2000 | 1000–2000 |
| 2 | >2000 | >2000 |
| 3 | 500–1000 | 500–1000 |
| 4 | 1000–2000 | 1000–2000 |

Table V shows that up to about from about 500 to 1000 mg/L of the invention compositions added to an aqueous solution exhibits relatively low biological toxicity.

EXAMPLE VI

A standard three electrode system was used for evaluating corrosion rates in the absence and the presence of inhibitor. The testing conditions were those simulating $CO_2$ amine service. An aqueous/acidified amine phase was used in the temperature range from 66°–127° C. The corrosive environment consisted of carbon dioxide ($CO_2$) saturated, 35 weight percent diethanolamine (DEA) solution containing 10,000 ppm formic acid (HCOOH), 8,000 ppm acetic acid ($CH_3COOH$), 500 ppm hydrochloric acid (HCl) and the balance water. Mild steel 1018 discs in glass electrochemical cells were used as working electrodes.

The solution was continuously purged with $CO_2$. Experiments were performed at working temperatures of 66, 83, 93, and 127° C. Treatment levels varied from 100–300 ppm.

The compositions tested were prepared at a temperature of 50°–60° C. and are shown in Table VI. Samples were tested for 18 hours. The test results are shown in Table VII. The tests were conducted in a laboratory environment to determine corrosion rates and percent of protection based on the equation:

$$\text{Percent protection}=[(C.R.\ b-C.R.\ i)/C.R.\ b]\times 100$$

where C.R.b is corrosion for the blank system and C.R.i is the corrosion for the treated solution.

TABLE VI

| Weight Percent | | | | | | | | | |
|---|---|---|---|---|---|---|---|---|---|
| $H_2O$ | MM | DDDA | EA | RAD1100 | Tenax 2010 | MM DDDA | EA DDDA | MM EA | Corrosion Inhibitor |
| 30 | 30 | 20 | 20 | 0 | 0 | 1.50 | 1.00 | 1.50 | MD #3 |
| 25 | 28 | 20 | 25 | 2 | 0 | 1.40 | 1.25 | 1.12 | MD #6 |
| 34 | 33 | 0 | 0 | 0 | 33 | — | — | — | M #8 |
| 34 | 32 | 0 | 0 | 2 | 32 | — | — | — | M #9 |

where MM is methyl morpholine;
DDDA is 1,12 dodecanedioic acid;
RAD1100 is Witco polyoxyethylated rosin amine;

TABLE VI-continued

| Weight Percent | | | | | | | | | |
|---|---|---|---|---|---|---|---|---|---|
| $H_2O$ | MM | DDDA | EA | RAD1100 | Tenax 2010 | MM DDDA | EA DDDA | MM EA | Corrosion Inhibitor |

Tenax 2010 is a tall oil fatty acid derivative available commercially from Westvaco and EA is diethanlamine for MD #3 and triethanol amine for MD #6.

TABLE VII

| Corrosion | Temp. = 66° C. Concentration | | Temp. = 83° C. Concentration | | Temp. = 93° C. Concentration |
|---|---|---|---|---|---|
| Inhibitor | 100 ppm | 200 ppm | 200 ppm | 300 ppm | 200 ppm |
| MD #3 | 63 | 81 | 85 | — | 91(89)* |
| MD #6 | — | — | — | — | 80 |
| M #8 | — | — | 88 | — | 72 |
| M #9 | — | — | 71 | — | 88 |

TABLE VII-continued

| Corrosion | Temp. = 66° C. Concentration | | Temp. = 83° C. Concentration | | Temp. = 93° C. Concentration |
|---|---|---|---|---|---|
| Inhibitor | 100 ppm | 200 ppm | 200 ppm | 300 ppm | 200 ppm |

where * indicates the results of two separate tests under the same conditions.

EXAMPLE VII

Mild steel 1018 (Cortest) samples were placed within an autoclave and submerged in an acidified DEA solution containing 300 ppm of MD#3 both as described in Example VI, A second set of samples were placed in the autoclave and submerged in the same acidified DEA solution but containing 300 ppm of M#9 as described in Example VI. The autoclave temperature was held at 260° F. and a $CO_2$ partial pressure was maintained at 20 psi. The sample was rotated at 100 rotations per minute for 18 hours. Under these conditions 300 ppm of MD #3 provided 87% protection while 300 ppm of M#9 did not provide any observable corrosion protection.

EXAMPLE VIII

Four 250 mL samples of 35% DEA solution as described in Example VI were treated, with corrosion inhibitors. A fifth 250 mL sample was left untreated to serve as a blank. The samples were placed in 500 mL cylinders having condenser heads. The cylinders were heated to 93° C. (200° F.) and sparged with nitrogen through a fine pore frit (size D) at 900 mL/min. The time for the foam to rise from the 250 mL line to its highest point and the time for the foam to fall back to the 250 mL line were recorded. As shown in Table VIII, MD#3 did not significantly affect the foaminess of the sample, yielding results equivalent to the blank. The M#8 and M#9 formulations were too foamy to accurately measure.

TABLE VIII

| Chemical Tested | ppm | Maximum Foaming Point | Time of foaming up 200° F., $N_2$ = 900 mL/min mean ± SD (sec) | Time of foaming down 200° F., $N_2$ = 0 mean ± SD (sec) |
|---|---|---|---|---|
| Blank | 0 | 430 mL | 6.6 ± 0.5, n = 5 | 6.8 ± 0.4, n = 5 |
| MD #3 | 300 | 430 mL | 7.0 ± 0.0, n = 5 | 7.6 ± 0.5, n = 5 |
| M #8 | 300 | over the top at 80° C. $N_2$ = 100 mL/min. | too foamy | too foamy |
| M #9 | 300 | over the top at 88° C. $N_2$ = 100 $m_c$/min. | too foamy | too foamy |

wherein SD is Standard Deviation and n is the number of tests performed.

While this invention has been described with respect to particular embodiments thereof, it is apparent that numerous other forms and modifications of the invention will be obvious to those skilled in the art. The appended claims and this invention generally should be construed to cover all such obvious forms and modifications which are within the true spirit and scope of the present invention.

We claim:

1. A method for inhibiting the corrosion of ferrous metals in contact with an aqueous oxygen-free solution comprising adding to said aqueous oxygen-free solution a corrosion inhibiting amount of a composition comprising n-alkyl morpholine having the formula:

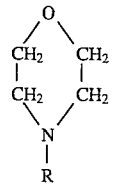

where R is an n-alkyl having from about 1 to about 4 carbon atoms; a saturated dicarboxylic acid having the formula:

$$HOOC—CH_2—(CH_2)_z—CH_2—COOH$$

where z=6 to 14; optionally an alkanol amine having the formula:

$(OH—R_1)_xNH_{x-y}$ where $R_1$ is an alkyl having from about 2 to 5 carbon atoms, x=2 or 3 and y=3; and optionally a surfactant.

2. The method of claim 1 wherein said composition is comprised of from about 10 weight percent to about 70 weight percent n-alkyl morpholine, from about 10 weight percent to about 55 weight percent saturated dicarboxylic acid, up to about 50 weight percent alkanol amine, up to about 30 weight percent water and up to about 2 weight percent surfactant.

3. The method of claim 2 wherein said corrosion inhibiting amount is sufficient to establish a concentration of from about 50 ppm to about 2000 ppm of said composition in said aqueous solution.

4. The method of claim 1 wherein said n-alkyl morpholine is methyl morpholine, said saturated dicarboxylic acid is 1, 12-dodecanedioic acid, and said alkanol amine is trierhanol amine.

5. The method of claim 1 wherein said n-alkyl morpholine is methyl morpholine, said saturated dicarboxylic acid is 1,12-dodecanedioic acid, and said alkanol amine is diethanol amine.

6. The method of claim 1 wherein said aqueous oxygen-free solution is an alkanol amine solution in a $CO_2$ removal amine unit.

7. The method of claim 1 wherein said aqueous oxygen-free solution is a crude-oil and water mixture.

8. The method of claim 2 wherein said surfactant is selected from the group consisting of a polyoxyethylated rosin amine, a tall oil fatty acid maleic anhydride or an ethoxylate of coco primary amine.

9. A method for inhibiting the corrosion of ferrous metals in contact with an aqueous oxygen-free solution comprising adding to said aqueous oxygen-free solution from about 50 ppm to about 2000 ppm of a composition comprising from about 10 weight percent to about 70 weight percent methyl morpholine, from about 10 weight percent to about 55 weight percent 1,12 dodecanedioic acid, up to 50 weight percent diethanol or triethanol amine and up to about 2 weight percent of a surfactant selected from the group consisting of a polyoxyethylated rosin amine, a tall oil fatty acid maleic anhydride or an ethoxylate of coco primary amine.

* * * * *